United States Patent [19]

Hachisu et al.

[11] Patent Number: 4,509,995

[45] Date of Patent: Apr. 9, 1985

[54] METHOD AND APPARATUS FOR QUENCHING

[75] Inventors: Takeshi Hachisu; Keiji Taguchi, both of Ibaraki; Toshimi Sasaki, Mito; Tetsuo Matsumoto, Tsuchiura; Nobuyoshi Hidao, Kashiwa, all of Japan

[73] Assignees: Hitachi, Ltd.; Hitachi Const. Machinery Co., both of Tokyo, Japan

[21] Appl. No.: 459,148

[22] Filed: Jan. 19, 1983

[30] Foreign Application Priority Data

Feb. 12, 1982 [JP] Japan ..... 57-19567

[51] Int. Cl.[3] ..... C21D 1/18

[52] U.S. Cl. ..... 148/143; 239/428.5

[58] Field of Search ..... 148/143, 153, 155, 156, 148/157; 239/424, 423, 428.5

[56] References Cited

U.S. PATENT DOCUMENTS

| | | | |
|---|---|---|---|
| 2,311,018 | 2/1943 | Bahnson, Jr. | 239/424 |
| 2,361,144 | 10/1944 | Loepsinger | 239/424 |
| 2,593,096 | 4/1952 | Brusdal | 239/424 |
| 3,407,099 | 10/1968 | Schell | 148/153 |
| 3,484,048 | 12/1969 | Mobius | 239/424 |
| 4,033,512 | 7/1977 | Beck | 239/423 |
| 4,232,853 | 11/1980 | Bando et al. | 266/114 |
| 4,329,188 | 5/1982 | Wang | 148/143 |
| 4,407,487 | 10/1983 | Wang | 266/114 |

FOREIGN PATENT DOCUMENTS

| | | | |
|---|---|---|---|
| 55-9926 | 3/1980 | Japan . | |
| 863044 | 9/1981 | U.S.S.R. | 72/201 |

*Primary Examiner*—L. Dewayne Rutledge
*Assistant Examiner*—Christopher W. Brody
*Attorney, Agent, or Firm*—Antonelli, Terry & Wands

[57] ABSTRACT

A quenching method wherein an object to be quenched is sprayed with a mixed spray jet of a liquid and a gas. The diameter of droplets in the mixed spray jet is from 50 to 200 μm, and the mixing ratio between the liquid and the gas is varied during the period from the start to the end of cooling. Also disclosed is a quenching apparatus having nozzles for spraying an object to be quenched with a mixed spray jet of a liquid and a gas, a liquid supply source for supplying a pressurized liquid, and a gas supply source for supplying a pressurized gas. Each of the nozzles has a liquid-jetting port formed in the surface opened to the atmosphere and a gas-jetting port annularly formed around the liquid-jetting port on the same plane. The liquid-jetting port is communicated with the liquid supply source, while the gas-jetting port is communicated with the gas supply source. A flow rate regulating valve for regulating the flow rate of the pressurized liquid is disposed between the liquid-jetting port and the liquid supply source, while a flow rate regulating valve for regulating the flow rate of the pressurized gas is disposed between the gas-jetting port and the gas supply source.

5 Claims, 5 Drawing Figures

METHOD AND APPARATUS FOR QUENCHING

BACKGROUND OF THE INVENTION

1. Field of the Invention

The present invention relates to a method and apparatus for quenching machine parts made of metallic materials apt to be cracked or deformed in quenching.

2. Description of the Prior Art

In a typical conventional fog quenching apparatus equipped with "two-fluid" spray nozzles for spraying a mixture of a liquid and a gas, the liquid (water) and the gas (air) are introduced into a mixing chamber for atomization, and the atomized mixture is jetted out from an outer-tip outlet to form a water-air mixture jet (referred to as "spray jet" hereinafter). The flow rate of the water is regulated by means of a needle valve, while the flow rate of the air is regulated by replacing a valve or an inner tip with another. The diameter of waterdroplets in the spray jet is extremely small: on the order of from 5 to 20 μm, showing an excellent atomization. Since the cooling power of this spray jet is relatively small, it is impossible to attain a strong cooling effect, particularly an effect close to that obtained by water cooling. The nozzles of this type have not only a necessity to make the air pressure smaller than the water pressure but also difficulty in regulating the characteristics of the spray jet, together with a complicated structure. In addition, since the water is jetted out from a small gap through the needle valve, the nozzle easily clogs, needing troublesome maintenance and frequent inspection.

In another conventional fog quenching apparatus equipped with spray nozzles similar to the above-mentioned "two-fluid" spray nozzles, the spray nozzles are supplied with water and air having fixed flow rates respectively, and the cooling capacity thereof is regulated by varying the distance between the spray nozzles and the surface of an object to be quenched. However, since a great many spray nozzles are provided, it undesirably takes much time and labor to reset the distance between all the spray nozzles and the surface to be cooled for coping with the variations in shape of objects to be quenched.

Moreover, in the conventional quenching methods employing "two-fluid" spray nozzles, quenching is carried out by means of mixture spray jets with a completely constant mixing ratio, without changing the flow rates of the liquid and the gas, i.e., the mixing ratio therebetween, during the period from the start to the end of cooling, which may cause quenching cracks or deformation.

SUMMARY OF THE INVENTION

Object of the Invention

It is an object of the present invention to provide a method and apparatus for quenching capable of regulating spray jets so that they are suitable to an object to be quenched by employing novel nozzles capable of obtaining a cooling effect close to that obtained by water cooling, which cannot be conventionally attained, thereby making it possible to quench even substances apt to be cracked or deformed in quenching without any quenching cracks or deformation.

Brief Summary of the Invention

According to one aspect of the invention, there is provided a quenching method wherein quenching is effected by applying a mixed spray jet of a liquid and a gas to an object to be quenched, characterized in that the diameter of droplets in the mixed spray jet is from 50 to 200 μm, and the mixing ratio between the liquid and the gas is varied during the period from the start to the end of cooling.

According to another aspect of the invention, there is provided a quenching apparatus for carrying out the above-mentioned quenching method, having nozzles for spraying a mixed spray jet of a liquid and a gas to an object to be quenched, a liquid supply source for supplying a pressurized liquid, and a gas supply source for supplying a pressurized gas, characterized by comprising: the nozzles each having a liquid-jetting port formed in the surface opened to the atmosphere and a gas-jetting port annularly formed around the liquid-jetting port, the liquid-jetting port being communicated with the liquid supply source, while the gas-jetting port being communicated with the gas supply source; a flow rate regulating valve for regulating the flow rate of the pressurized liquid, disposed between the liquid-jetting port and the liquid supply source; and a flow rate regulating valve for regulating the flow rate of the pressurized gas, disposed between the gas-jetting port and the gas supply source.

Above and other objects and features of the invention will be apparent from the following description of preferred embodiments when the same is read in conjunction with the accompanying drawings.

DESCRIPTION OF THE PREFERRED EMBODIMENTS

Preferred embodiments of the invention will be described hereinunder with reference to the accompanying drawings.

Figure 1:
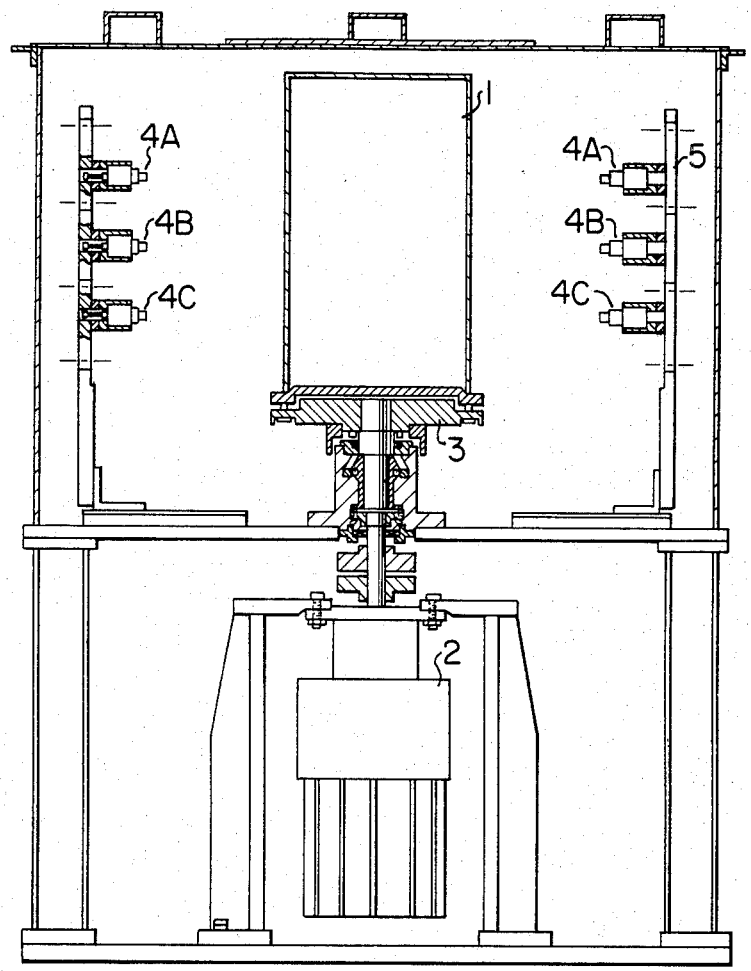
FIG. 1 schematically illustrates a quenching apparatus in accordance with a preferred embodiment of the invention for carrying out a quenching method according to the invention.
Figure 2:
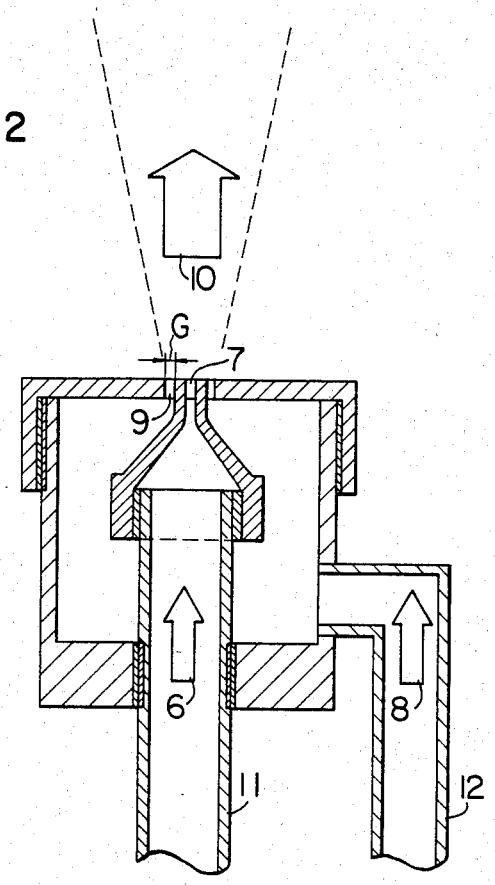
FIG. 2 is a sectional view of a nozzle employed in the quenching apparatus shown in FIG. 1.

Referring to FIG. 1, an object 1 to be quenched is vertically mounted on a supporting table 3 rotated by means of a driving gear 2. The supporting table 3 is rotated at a rotational frequency on the order of from 5 to 20 rpm in order to prevent production of circumferential soft spots in the quenching process. Nozzles 4A–4C are disposed on the circumferences of horizontal planes in a plurality of stages (three stages are shown in the Figure) on the inner peripheral wall of a support (various arranging structures are available, such as an annular support or a semiannular support) 5 surrounding the object 1, each stage having any desired number of nozzles. These nozzles 4A–4C are divided into any desired number of groups. As shown in FIG. 2, each of the nozzles 4A–4C comprises a liquid-jetting port 7 with a diameter of from 1 to 2 mm for jetting out water (although water is employed in this embodiment, any liquid may be available besides water) 6 and a gas-jetting port 9 formed on the same plane and concentrically with the liquid-jetting port 7, for jetting out air (although air is employed in this embodiment, any cooling gas, such as an inert gas, may be available besides air) 8. The water and the air jetted out from the ports 7, 9 respectively are mixed together to form a water-air mixture spray jet 10. An annular gap between the liquid-jetting port 7 and the gas-jetting port 9 is set so as to be on the order of from 0.2 to 0.7 mm in order to reduce noises and vibrations as well as the air consumption.

The liquid-jetting port 7 and the gas-jetting port 9 are formed on the same plane opened to the atmosphere, thereby facilitating fine adjustment of spray. In addition, if the diameter of the liquid-jetting port 7 is not more than 1 mm, it easily clogs, and if the diameter is not less than 2 mm, the liquid is not well atomized, and it is also difficult to effect fine adjustment of the water flow rate.

Figure 3:
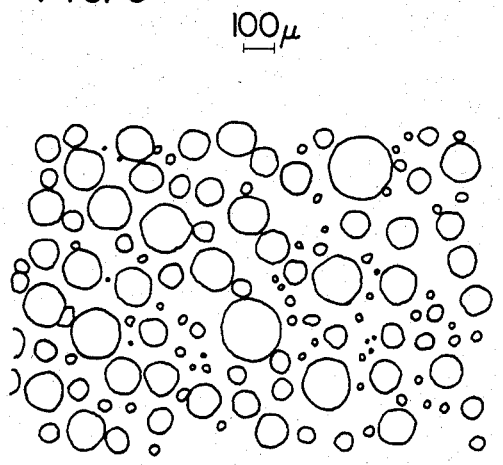
FIG. 3 is an enlarged view showing the diameter distribution of waterdroplets in a water-air mixture spray jet jetted out from the nozzle shown in FIG. 2.

The diameter of waterdroplets included in the water-air mixture spray jet 10 obtained from a "two-fluid" spray nozzle constituted by the above-mentioned ports 7, 9 is large: from 50 to 200 μm, as illustrated in FIG. 3, showing that the water is not much atomized. Consequently, the cooling power of the mixture spray jet 10 is large, so that it is possible to well attain a cooling effect close to that obtained by water cooling if the distance between the nozzles and the surface to be cooled is made smaller.

It is possible to effect the quenching by discharging the air from the central liquid-jetting port 7 while discharging the water from the peripheral gas-jetting ports 9 so as to form a mixture spray jet. By so doing, it is possible to obtain a greater quenchable region.

Figure 4:
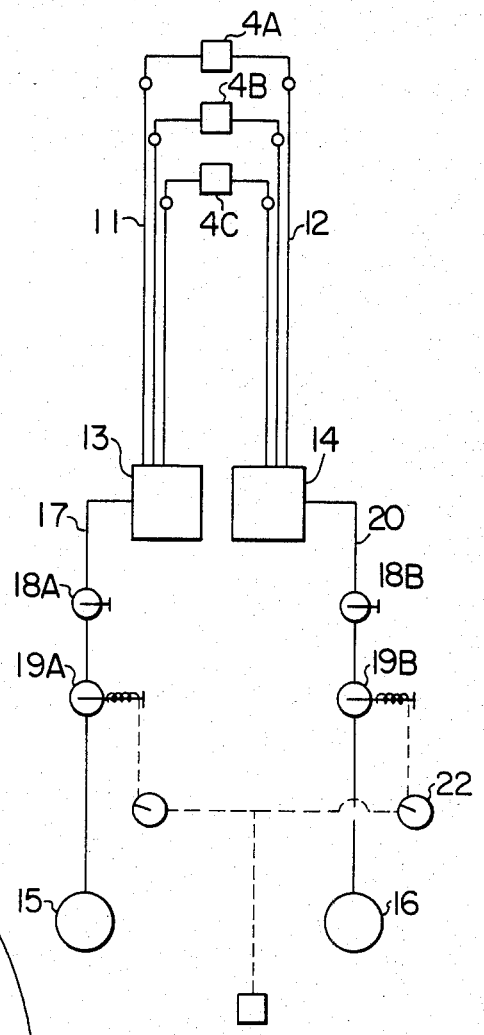
FIG. 4 illustrates a supply system for supplying a liquid and a gas to the nozzle shown in FIG. 2.

Each of groups of water supply tubes 11 and that of air supply tubes 12 of the nozzles 4A–4C are connected to concentrated pipes 13, 14, respectively, as shown in FIG. 4. These concentrated pipes 13, 14 having a function of small header, are connected to a water supply source 15 (a container having a large capacity, filled with a high-pressure water, for example) capable of thoroughly supplying high-pressure water and an air supply source 16 (a container having a large capacity, filled with high-pressure air, for example) capable of thoroughly supplying high-pressure air, respectively. A flow rate regulating valve 18A and a solenoid valve 19A are provided in a passage 17 connecting the concentrated pipe 13 and the water supply source 15, while a flow rate regulating valve 18B and a solenoid valve 19B are provided in a passage 20 connecting the concentrated pipe 14 and the air supply source 16. The flow rate regulating valves 18A, 18B have openings so set as to obtain the water and air flow rates according to a predetermined cooling program, while the solenoid valves 19A, 19B are opened or closed following instructions from timers 21, 22, respectively.

The above-mentioned program has such a timetable as follows: for example, the first 30 seconds after the start of cooling is an air-cooling period for jetting out only air; the next 15 seconds between 30 seconds and 45 seconds after the start of cooling is a cooling period for jetting out water at a flow rate of 15 l/min (a total flow rate; the water is equally distributed among the nozzles); the next 15 seconds between 45 seconds and 60 seconds after the start of cooling is a cooling period for jetting out water at a flow rate of 5 l/min; and the next 30 seconds between 60 seconds and 90 seconds after the start of cooling is an air-cooling period for jetting out no water but only air. It is to be noted that the air-cooling periods can be omitted depending on the material and shape of the object to be quenched. Such a cooling program is determined according to the material, shape and quenching specifications of the object to be quenched, together with a heat transfer calculation and the CCT curve of material of the object to be quenched as well as tests carried out by employing test specimens based on experience according to need. In case of quenching the upper and lower half parts of the object differently from each other, the nozzle groups are divided into two and cooling programs different from each other are run, thereby attaining the purpose.

Figure 5:
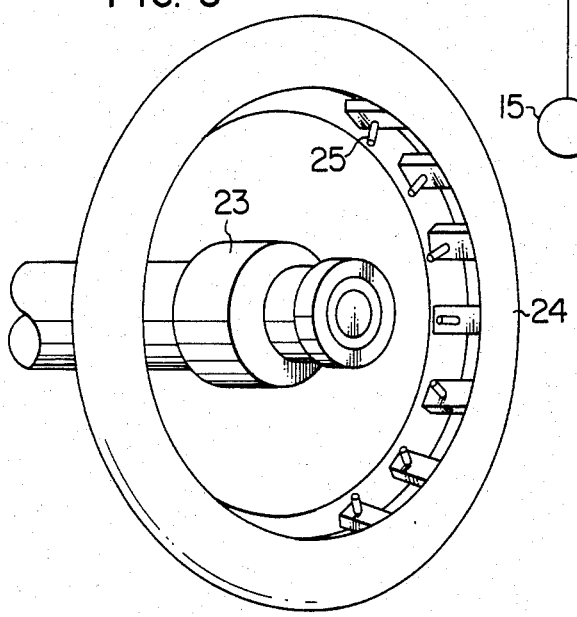
FIG. 5 illustrates a relationship in arrangement between an object to be quenched and nozzles of a quenching apparatus in accordance with another preferred embodiment of the invention.

FIG. 5 shows another preferred embodiment of the invention. This embodiment has such a structure that nozzles 25 are mounted on the inner peripheral surface of a ring-shaped member 24 disposed perpendicularly to the axis of an object 23 to be quenched having a horizontal axis of rotation. The nozzles 25 are divided into any desired number of groups and arranged so that the mixed spray jets jetted out from the nozzles constituting each group are applied to a portion to be quenched on the surface of the object 23. The other part of the arrangement is the same as the first-described embodiment. The embodiment thus arranged is best suitable for automating operations carried out in quenching the object.

As will be fully understood from the foregoing description, according to the invention, it is possible to obtain a method and apparatus for quenching capable of quenching metallic materials apt to be cracked or deformed in quenching without any quenching cracks or deformation by means of the novel nozzles and the regulation of the flow rates of a liquid and a gas during cooling.

Although the invention has been described through specific terms, it is to be noted here that the described embodiments are not exclusive and various changes and modifications may be imparted thereto without departing from the scope of the invention which is limited solely by the appended claims.

What is claimed is:

1. A batch-type quenching method wherein a mixed spray jet of a liquid and a gas is applied to at least one discrete object to be quenched during a period of cooling, comprising the steps of providing a supply of said liquid under pressure and a supply of said gas under pressure, providing nozzles around said object to be quenched for applying said mixed spray jet of said liquid and said gas to said object, said nozzles each including a first port in a surface opened to the atmosphere and a second port annularly formed around said first port, said first and second ports being formed on the same plane, directing liquid from said supply of pressure liquid through one of said first and second ports in said nozzle and at the same time directing gas from said supply of pressurized gas through the other of said first and second ports in said nozzle so that said liquid and said gas are jetted out from respective ones of said first and second ports to form a liquid-gas mixture spray jet which impinges upon said object to be quenched during said period of cooling, and varying the mixing ratio between said liquid and said gas in said mixed spray jet during said period of cooling of said object to be quenched, the step of varying the mixing ratio including spraying only said gas and subsequently spraying a mixture of said liquid and said gas and wherein the diameter of droplets in said mixed spray jet is from 50 to 200 μm.

2. A quenching method as defined in claim 1, wherein said mixing ratio is varied by adjusting the flow rate of at least one of said gas and said liquid being directed to said nozzle from the respective supplies of said liquid and said gas.

3. A quenching method as defined in claim 1, wherein the mixing ratio of said mixed spray jet is continuously varied.

4. A quenching method as defined in claim 1, wherein the mixing ratio of said mixed spray jet is stepwise changed.

5. A quenching method as defined in claim 1, wherein said period of cooling is started with air cooling, followed by a cooling period by means of said mixed spray jet, and said cooling is finished with air cooling.

* * * * *